US012264293B2

(12) United States Patent
Watanabe et al.

(10) Patent No.: US 12,264,293 B2
(45) Date of Patent: Apr. 1, 2025

(54) GREASE COMPOSITION

(71) Applicant: IDEMITSU KOSAN CO., LTD., Chiyoda-ku (JP)

(72) Inventors: Go Watanabe, Chiyoda-ku (JP); Keisuke Inda, Chiyoda-ku (JP); Kouji Takane, Chiyoda-ku (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 18/552,377

(22) PCT Filed: Mar. 31, 2022

(86) PCT No.: PCT/JP2022/016962
§ 371 (c)(1),
(2) Date: Sep. 25, 2023

(87) PCT Pub. No.: WO2022/211119
PCT Pub. Date: Oct. 6, 2022

(65) Prior Publication Data

US 2024/0174943 A1 May 30, 2024

(30) Foreign Application Priority Data

Mar. 31, 2021 (JP) ..... 2021-062426

(51) Int. Cl.
*C10M 169/06* (2006.01)
*C10N 20/02* (2006.01)
(Continued)

(52) U.S. Cl.
CPC ..... *C10M 169/06* (2013.01); *C10M 2215/30* (2013.01); *C10M 2217/0456* (2013.01);
(Continued)

(58) Field of Classification Search
CPC ..... C10M 169/06; C10M 2215/30; C10M 2217/0456; C10N 2020/02; C10N 2020/06; C10N 2030/06; C10N 2050/10
See application file for complete search history.

(56) References Cited

U.S. PATENT DOCUMENTS 5,604,187 A 2/1997 Takeuchi et al.
6,667,281 B2 12/2003 Ikejima et al.
(Continued)

FOREIGN PATENT DOCUMENTS

JP 9-255983 A 9/1997
JP 2002-180076 A 6/2002
(Continued)

OTHER PUBLICATIONS

International Search Report issued on Jun. 14, 2022 in PCT/JP2022/016962 (with English translation), 7 pages.
(Continued)

*Primary Examiner* — Ellen M McAvoy
(74) *Attorney, Agent, or Firm* — Oblon, McClelland, Maier & Neustadt, L.L.P.

(57) ABSTRACT

A grease composition, containing a base oil (A), a urea-based thickener (B), and melamine cyanurate (C). Particles containing the urea-based thickener (B) in the grease composition satisfy the following requirement (I): the particles have an area-based arithmetic average particle diameter of 2.0 μm or less, as measured by a laser diffraction/scattering method.

20 Claims, 2 Drawing Sheets

(51) Int. Cl.
*C10N 20/06* (2006.01)
*C10N 30/06* (2006.01)
*C10N 50/10* (2006.01)

(52) U.S. Cl.
CPC ..... *C10N 2020/02* (2013.01); *C10N 2020/06* (2013.01); *C10N 2030/06* (2013.01); *C10N 2050/10* (2013.01)

(56) References Cited

U.S. PATENT DOCUMENTS

| | | | | |
|---|---|---|---|---|
| 2014/0038865 | A1 | 2/2014 | Shimura et al. | |
| 2015/0024981 | A1 | 1/2015 | Ayame et al. | |
| 2017/0362530 | A1 | 12/2017 | Hirooka et al. | |
| 2018/0037842 | A1* | 2/2018 | Suetsugu | B01J 19/1806 |
| 2020/0148970 | A1* | 5/2020 | Watanabe | C10M 169/06 |
| 2021/0095219 | A1* | 4/2021 | Watanabe | C10M 115/08 |
| 2022/0135897 | A1* | 5/2022 | Shishikura | F16H 57/0464 508/331 |
| 2022/0145203 | A1 | 5/2022 | Watanabe | |
| 2022/0162513 | A1* | 5/2022 | Shishikura | C10M 169/00 |
| 2023/0049828 | A1* | 2/2023 | Yano | C10M 141/10 |
| 2023/0128223 | A1* | 4/2023 | Watanabe | C10M 101/02 508/427 |
| 2024/0059996 | A1* | 2/2024 | Arai | C10M 135/22 |
| 2024/0158715 | A1* | 5/2024 | Matsueda | C10M 125/22 |
| 2024/0174942 | A1* | 5/2024 | Inda | C10M 169/06 |

FOREIGN PATENT DOCUMENTS

| | | | |
|---|---|---|---|
| JP | 2005-281457 | A | 10/2005 |
| JP | 2006-298963 | A | 11/2006 |
| JP | 2008-31249 | A | 2/2008 |
| JP | 2009-13350 | A | 1/2009 |
| JP | 2011-202061 | A | 10/2011 |
| JP | 2012-102157 | A | 5/2012 |
| WO | WO 2011/142411 | A1 | 11/2011 |
| WO | WO 2013/133149 | A1 | 9/2013 |
| WO | WO 2016/104812 | A1 | 6/2016 |
| WO | WO 2019/044624 | A1 | 3/2019 |
| WO | WO 2020/179589 | A1 | 9/2020 |
| WO | WO 2020/179595 | A1 | 9/2020 |
| WO | WO 2020/179603 | A1 | 9/2020 |

OTHER PUBLICATIONS

Written Opinion issued on Jun. 14, 2022 in PCT/JP2022/016962 (with English translation), 10 pages.
Extended European Search Report issued Jul. 24, 2024 in European Patent Application No. 22781326.8, 6 pages.

* cited by examiner

GREASE COMPOSITION

CROSS REFERENCE TO RELATED APPLICATIONS

This application is a National Stage entry under 35 U.S.C. § 371 of PCT/JP2022/016962, filed on Mar. 31, 2022, and claims priority to Japanese Patent Application No. 2021-062426, filed on Mar. 31, 2021. The entire contents of both are incorporated herein by reference.

TECHNICAL FIELD

The present invention relates to a grease composition.

BACKGROUND ART

A grease composition is easily sealed as compared with a lubricating oil, and can reduce the size and weight of a machine to which the grease composition is applied. Therefore, the grease composition has been widely used for lubricating various sliding parts of automobiles, electrical equipment, industrial machinery, industrial machines, and the like.

In recent years, from the viewpoint of weight reduction, quietness, and the like, use of a resin material as a member of a sliding portion has been considered.

For example, in a worm gear of an electric power steering (EPS) of an automobile, a material of the worm is generally metal from the viewpoint of strength. On the other hand, as a material of a worm wheel, a resin is often used from the viewpoints of weight reduction of automobile parts, prevention of generation of unpleasant sound such as gear rattle and vibration sound due to contact with the worm (quietness), prevention of seizure with the worm, and the like. As a resin to be used, for example, a polyamide-based resin is known.

As described above, there is a demand for a grease composition which is suitable for lubrication of a sliding portion composed of a metal material such as a worm and a resin material such as a worm wheel.

Here, in order to enhance the lubricating performance, addition of melamine cyanurate, which is a solid lubricant, to a lubricant composition has been studied.

For example, PTL 1 discloses a resin-metal sliding lubricant composition containing a base oil containing a fluorine-based polyether oil and melamine cyanurate as a lubricant composition suitable for lubrication of a sliding portion composed of a metal material and a resin material.

Further, PTL 2 discloses, as a grease composition containing melamine cyanurate, a grease composition containing a base oil composed of a synthetic hydrocarbon oil, a thickener composed of a lithium soap, and melamine cyanurate.

CITATION LIST

Patent Literature

PTL 1: JP 2012-102157 A
PTL 2: JP 2009-13350 A

SUMMARY OF INVENTION

Technical Problem

However, the resin-metal sliding lubricant composition disclosed in PTL 1 is not a grease composition containing a base oil and a thickener. In addition, the base oil is not a mineral oil or a hydrocarbon-based synthetic oil that is generally used.

Moreover, the grease composition disclosed in PTL 2 improves friction characteristics at a sliding portion between rubber members or between a rubber member and a resin member.

Therefore, no study has been made on a grease composition in which melamine cyanurate is blended and which is suitable for lubrication of a sliding portion composed of a metal material and a resin material.

In recent years, the EPS has been increasingly employed also in large-sized vehicles. Since a larger force is applied to a large-sized vehicle than to a conventional automobile, a worm wheel formed of a conventional resin material may have insufficient strength. Therefore, as a material of the worm wheel, a resin in which glass fiber is mixed to improve strength has been used.

In a reinforced resin containing glass fibers, since the glass fibers tend to be vertically oriented on the surface of the resin or the like, the contact metal surface of the worm scratches the glass fibers and the glass fibers are broken, so that defects are likely to occur on the surface of the resin material. Further, when a high load is applied to the resin material for a long period of time, defects of the resin material progress, and wear may increase. Therefore, there is a demand for a grease composition capable of reducing the amount of wear even in a sliding portion composed of a metal material and a resin material having performance different from that of a conventional one.

However, in the resin-metal sliding lubricant composition of PTL 1 and the grease composition of PTL 2, the wear resistance between a metal material and a resin material is not examined at all.

Therefore, an object of the present invention is to provide a grease composition having excellent wear resistance.

Solution to Problem

In a grease composition containing a base oil and a urea-based thickener, the present inventors focused on the particle size of particles containing the urea-based thickener in the grease composition. Then, it was found that the arithmetic average particle diameter on an area basis when the particles are measured by a laser diffraction/scattering method is adjusted to a predetermined range, and a grease composition containing melamine cyanurate can solve the above-mentioned problems, and thus the present invention was completed.

That is, the present invention provides the following [1].

[1] A grease composition containing a base oil (A), a urea-based thickener (B), and melamine cyanurate (C), wherein particles containing the urea-based thickener (B) in the grease composition satisfy the following requirement (I):

Requirement (I): The particles have an area-based arithmetic average particle diameter of 2.0 μm or less, as measured by a laser diffraction/scattering method.

Advantageous Effects of Invention

According to the present invention, it is possible to provide a grease composition having excellent wear resistance.

DESCRIPTION OF EMBODIMENTS

Figure 1:
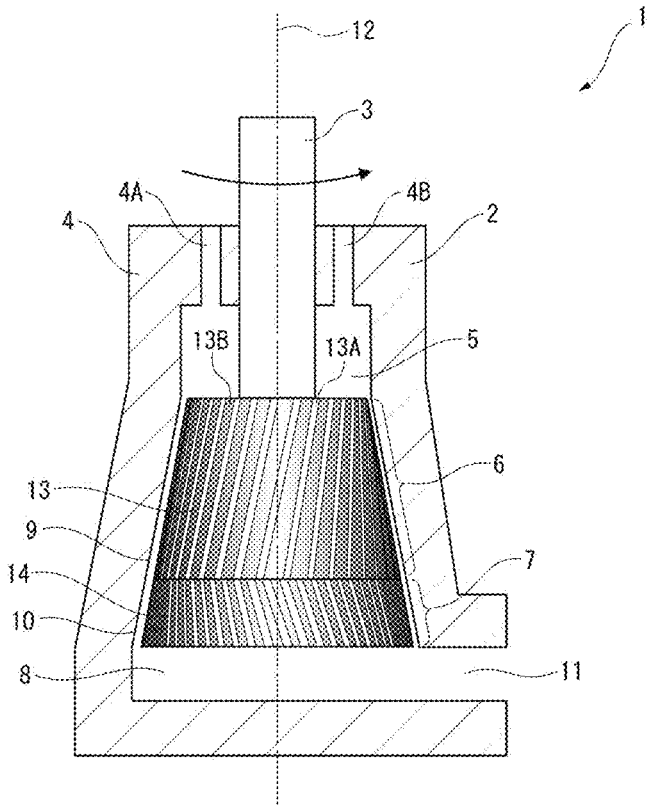
FIG. 1 is a schematic view of a cross section of a grease manufacturing apparatus, used in one embodiment of the present invention.

In the description herein, a lower limit value and an upper limit value stepwise described for a preferred numerical range (for example, a range of content) can be individually independently combined. For example, from a description of "preferably 10 to 90, more preferably 30 to 60", "a preferred lower limit value (10)" and "a more preferred upper limit value (60)" can be combined to be "10 to 60".

Also in the description herein, the numerical value in Examples is a numerical value usable as an upper limit value or a lower limit value.

In the description herein, the mass average molecular weight (Mw) and the number average molecular weight (Mn) of each component are values in terms of standard polystyrene measured by a gel permeation chromatography (GPC) method, and specifically mean values measured by a method described in Examples.

In the description herein, for example, "(meth)acrylate" is used as a term indicating both "acrylate" and "methacrylate", and the same applies to other similar terms and similar notations.

[Grease Composition]

The grease composition of the present invention is a grease composition containing a base oil (A), a urea-based thickener (B), and melamine cyanurate (C), wherein particles containing the urea-based thickener (B) in the grease composition satisfy the following requirement (I):

Requirement (I): The particles have an area-based arithmetic average particle diameter of 2.0 μm or less, as measured by a laser diffraction/scattering method.

In the following description, "base oil (A)", "urea-based thickener (B)", and "melamine cyanurate (C)" are also referred to as "component (A)", "component (B)", and "component (C)", respectively.

In the grease composition according to one embodiment of the present invention, the total content of the component (A), the component (B), and the component (C) is preferably 60% by mass or more, more preferably 70% by mass or more, still more preferably 80% by mass or more, and even more preferably 90% by mass or more, based on the total amount (100% by mass) of the grease composition. On the other hand, it is usually 100% by mass or less, preferably less than 100% by mass, more preferably 99% by mass or less, and still more preferably 98% by mass or less.

The grease composition according to one embodiment of the present invention may contain one or more components other than the component (A), the component (B), and the component (C) as long as the effects of the present invention are not impaired.

In the grease composition according to one embodiment of the present invention, an oily agent (D), an anti-wear agent (E), a friction reducing agent (F), and an additive (G) can be contained as necessary.

In the following description, "oily agent (D)", "anti-wear agent (E)", and "friction reducing agent (F)" are also referred to as "component (D)", "component (E)", and "component (F)", respectively.

When the component (D), the component (E), and the component (F) are contained as necessary, the total content of the component (A), the component (B), the component (C), the component (D), the component (E), and the component (F) is preferably 60% by mass or more, more preferably 70% by mass or more, still more preferably 80% by mass or more, and even more preferably 90% by mass or more, based on the total amount (100% by mass) of the grease composition. On the other hand, it is usually 100% by mass or less, preferably less than 100% by mass, more preferably 99% by mass or less, and still more preferably 98% by mass or less.

As a result of intensive studies to solve the above problems, the present inventors have found that a grease composition having excellent wear resistance can be obtained when the grease composition contains melamine cyanurate (C).

Specifically, the present inventors have found the following.

As described above, in a reinforced resin containing glass fibers, since the glass fibers tend to be vertically oriented on the surface of the resin or the like, the contact metal surface of the worm scratches the glass fibers and the glass fibers are broken, so that defects are likely to occur on the surface of the resin material.

Here, it is presumed that when the resin material and the grease composition containing melamine cyanurate come into contact with each other, the melamine cyanurate, which is a solid lubricant, enters defects generated on the surface of the resin material, and the melamine cyanurate plays a role of filling the defects. In addition, it is presumed that even when a high load is applied to the resin material for a long period of time, the progress of defects in the resin material is suppressed. Therefore, it has been found that a grease composition containing melamine cyanurate can reduce the amount of wear.

<Requirement (I)>

In the grease composition of the present invention, the particles containing the urea-based thickener (B) in the grease composition satisfy the following requirement (I).

Requirement (I): The particles have an area-based arithmetic average particle diameter of 2.0 μm or less, as measured by a laser diffraction/scattering method.

By satisfying the above requirement (I), the grease composition has excellent wear resistance.

The requirement (I) can be said to be a parameter that indicates the condition of aggregation of the urea-based thickener (B) in the grease composition.

Here, the "particles containing the urea-based thickener (B)" to be a target for measurement according to a laser diffraction/scattering method indicate particles formed by aggregation of the urea-based thickener (B) contained in the grease composition.

In the case where the grease composition contains any other additive than the urea-based thickener (B), the particle diameter defined by the requirement (I) can be determined by measuring a grease composition prepared under the same condition but not blending the additive, according to a laser diffraction/scattering method. However, when the additive is liquid at room temperature (25° C.), or when the additive is dissolved in the base oil (A), the grease composition in which the additive is blended may be the measurement target.

The urea-based thickener (B) is usually obtained by reacting an isocyanate compound with a monoamine, but since the reaction rate is very high, the urea-based thickener (B) is aggregated, and large particles (micelle particles, so-called "lumps") are likely to be excessively generated. As a result of intensive studies, the present inventors have found that, when the particle diameter defined by the requirement (I) exceeds 2.0 μm, the wear resistance of the grease composition cannot be ensured in the case where the worked penetration of the grease composition is increased. That is, it was found that when the particle diameter defined by the requirement (I) exceeds 2.0 μm, it is difficult to obtain a grease composition having excellent wear resistance even when the melamine cyanurate (C) is used.

On the other hand, as a result of intensive studies, the present inventors have found that a grease composition having excellent wear resistance can be obtained by micronizing the particle diameter defined by the requirement (I) to 2.0 μm or less in combination with melamine cyanurate (C).

It is presumed that this effect is achieved because the particles containing the urea-based thickener (B) easily enter a lubricating portion (friction surface) of a worm gear or the like and are hardly removed from the lubricating portion by micronizing the particle diameter defined by the requirement (I) to 2.0 μm or less, and thus the holding power of the grease composition in the lubricating portion is improved. In addition, by micronizing the particle diameter defined by the requirement (I) to 2.0 μm or less, the holding power of the base oil (A) by the particles is improved. Therefore, it is presumed that the action of allowing the base oil (A) to satisfactorily spread over the lubricating portion (friction surface) of the worm gear or the like and allowing the melamine cyanurate (C) to satisfactorily spread over the lubricating portion in accordance with the spreading of the base oil (A) is improved, and thus the wear resistance is improved.

From the above point of view, in the grease composition according to one embodiment of the present invention, the particle diameter defined by the above requirement (I) is preferably 1.5 μm or less, more preferably 1.0 μm or less, still more preferably 0.9 μm or less, even more preferably 0.8 μm or less, yet still more preferably 0.7 μm or less, yet even more preferably 0.6 μm or less, further more preferably 0.5 μm or less, and still further more preferably 0.4 μm or less. On the other hand, it is usually 0.01 μm or more.

<Requirement (II)>

Here, it is preferred that the grease composition according to one embodiment of the present invention further satisfies the following requirement (II).

Requirement (II): The particles have a specific surface area of $0.5\times10^5$ $cm^2/cm^3$ or more, as measured by a laser diffraction/scattering method.

The specific surface area defined by the above requirement (II) is a secondary index that indicates the state of micronization of the particles containing the urea-based thickener (B) in the grease composition and the presence of large particles (lumps). That is, by satisfying the requirement (I) and further satisfying the requirement (II), the state of micronization of the particles containing the urea-based thickener (B) in the grease composition is more favorable, and the presence of large particles (lumps) is further suppressed. Therefore, it is possible to provide a grease composition which is excellent in wear resistance and in which the effect of the melamine cyanurate (C) is easily exhibited.

From the above viewpoint, the specific surface area defined by the above requirement (II) is preferably $0.7\times10^5$ $cm^2/cm^3$ or more, more preferably $0.8\times10^5$ $cm^2/cm^3$ or more, still more preferably $1.2\times10^5$ $cm^2/cm^3$ or more, even more preferably $1.5\times10^5$ $cm^2/cm^3$ or more, yet still more preferably $1.8\times10^5$ $cm^2/cm^3$ or more, and yet even more preferably $2.0\times10^5$ $cm^2/cm^3$ or more. On the other hand, the specific surface area is generally $1.0\times10^6$ $cm^2/cm^3$ or less.

In the description herein, the values defined by the requirement (I) and further the requirement (II) are values measured by a method described in Examples described later.

In addition, the values defined by the requirement (I) and further the requirement (II) can be adjusted mainly by the production conditions of the urea-based thickener (B).

Hereinafter, each component contained in the grease composition of the present invention will be described in detail while paying attention to specific means for adjusting the values defined by the requirement (I) and further the requirement (II).

<Base Oil (A)>

The base oil (A) contained in the grease composition of the present invention may be one or more selected from mineral oils and synthetic oils.

Examples of the mineral oil include distillate oils obtained by subjecting a paraffin crude oil, an intermediate base crude oil, or a naphthenic crude oil to atmospheric distillation or vacuum distillation, and refined oils obtained by refining these distillate oils in accordance with a conventional method.

Examples of the purification method include a solvent dewaxing treatment, a hydroisomerization treatment, a hydrofinishing treatment, and a clay treatment.

Examples of the synthetic oil include a hydrocarbon-based oil, an aromatic oil, an ester-based oil, an ether-based oil, and a synthetic oil obtained by isomerizing a wax (GTL wax) produced by a Fischer-Tropsch method or the like.

Examples of the hydrocarbon-based oil include a poly-α-olefin (PAO), such as normal paraffin, isoparaffin, polybutene, polyisobutylene, a 1-decene oligomer, and a cooligomer of 1-decene and ethylene; and a hydrogenated product thereof.

Examples of the aromatic oil include an alkylbenzene such as a monoalkylbenzene, and a dialkylbenzene; and an alkylnaphthalene such as a monoalkylnaphthalene, a dialkylnaphthalene, and a polyalkylnaphthalenes.

Examples of the ester-based oil include a diester-based oil, such as dibutyl sebacate, di-2-ethylhexyl sebacate, dioctyl adipate, diisodecyl adipate, ditridecyl adipate, ditridecyl glutarate, and methyl acetyl ricinolate; an aromatic ester-based oil, such as trioctyl trimellitate, tridecyl trimellitate, and tetraoctyl pyromellitate; a polyol ester-based oil, such as trimethylolpropane caprylate, trimethylolpropane pelargonate, pentaerythritol-2-ethylhexanoate, and pentaerythritol pelargonate; and a complex ester-based oil, such as an oligoester of a polyhydric alcohol with a mixed fatty acid of a dibasic acid and a monobasic acid.

Examples of the ether-based oil include a polyglycol, such as polyethylene glycol, polypropylene glycol, polyethylene glycol monoether, and polypropylene glycol monoether; and a phenyl ether-based oil, such as a monoalkyl triphenyl ether, an alkyl diphenyl ether, a dialkyl diphenyl ether, a pentaphenyl ether, tetraphenyl ether, a monoalkyl tetraphenyl ether, and a dialkyl tetraphenyl ether.

The base oil (A) of the present embodiment preferably has a 40° C. kinematic viscosity of 10 $mm^2/s$ or more, more preferably 20 $mm^2/s$ or more, and still more preferably 30 $mm^2/s$ or more. When the 40° C. kinematic viscosity of the base oil (A) is 10 $mm^2/s$ or more, the effects of the present invention are more easily exhibited.

On the other hand, the base oil (A) of the present embodiment preferably has a 40° C. kinematic viscosity of 420 $mm^2/s$ or less, more preferably 300 $mm^2/s$ or less, and still more preferably 200 $mm^2/s$ or less. When the 40° C.

kinematic viscosity of the base oil (A) is 420 $mm^2/s$ or less, the effects of the present invention are more easily exhibited.

The upper limit values and the lower limit values of these numerical ranges can be arbitrarily combined. Specifically, it is preferably 10 to 420 $mm^2/s$, more preferably 20 to 300 $mm^2/s$, and still more preferably 30 to 200 $mm^2/s$.

The base oil (A) used in one embodiment of the present invention may be a mixed base oil prepared by combining a high-viscosity base oil and a low-viscosity base oil so as to have a kinematic viscosity in the above range.

The viscosity index of the base oil (A) used in one embodiment of the present invention is preferably 90 or more, more preferably 110 or more, and still more preferably 130 or more.

In the description herein, the kinematic viscosity and the viscosity index each mean a value measured or calculated in accordance with JIS K 2283:2000.

In the grease composition according to one embodiment of the present invention, the content of the base oil (A) is, based on the total amount (100% by mass) of the grease composition, preferably 50% by mass or more, more preferably 55% by mass or more, still more preferably 60% by mass or more, and even more preferably 62% by mass or more, and is preferably 98.5% by mass or less, more preferably 97% by mass or less, still more preferably 95% by mass or less, and even more preferably 93% by mass or less.

<Urea-Based Thickener (B)>

The urea-based thickener (B) contained in the grease composition of the present invention may be a compound having a urea bond, and is preferably a diurea compound having two urea bonds, more preferably a diurea compound represented by the following general formula (b1).

$$R^1—NHCONH—R^3—NHCONH—R^2 \quad (b1)$$

The urea-based thickener (B) for use in one embodiment of the present invention may be composed of one kind, or may be a mixture of two or more kinds.

In the general formula (b1), $R^1$ and $R^2$ each independently represent a monovalent hydrocarbon group having 6 to 24 carbon atoms. $R^1$ and $R^2$ may be identical to each other, or may be different from each other. $R^3$ represents a divalent aromatic hydrocarbon group having 6 to 18 carbon atoms.

The carbon number of the monovalent hydrocarbon group which can be selected as $R^1$ and $R^2$ in the general formula (b1) is 6 to 24, preferably 6 to 20, and more preferably 6 to 18.

Examples of the monovalent hydrocarbon group which can be selected as $R^1$ and $R^2$ include a saturated or unsaturated monovalent chain hydrocarbon group, a saturated or unsaturated monovalent alicyclic hydrocarbon group, and a monovalent aromatic hydrocarbon group.

Here, in $R^1$ and $R^2$ in the general formula (b1), when the content of the chain hydrocarbon group is X molar equivalent, the content of the alicyclic hydrocarbon group is Y molar equivalent, and the content of the aromatic hydrocarbon group is Z molar equivalent, the following requirements (a) and (b) are preferably satisfied.

Requirement (a): The value of $[(X+Y)/(X+Y+Z)]\times100$ is 90 or more (preferably 95 or more, more preferably 98 or more, and still more preferably 100).

Requirement (b): The X/Y ratio is 0/100 (X=0, Y=100) to 100/0 (X=100, Y=0) (preferably 10/90 to 90/10, more preferably 80/20 to 20/80, and still more preferably 70/30 to 40/60).

Since the alicyclic hydrocarbon group, the chain hydrocarbon group, and the aromatic hydrocarbon group are groups selected as $R^1$ and $R^2$ in the general formula (b1), the total sum of the values of X, Y, and Z is 2 molar equivalents with respect to 1 mol of the compound represented by the general formula (b1). Further, the values of the above requirements (a) and (b) mean average values with respect to the total amount of the compounds represented by the above general formula (b1) contained in the grease composition.

By using the compound represented by the general formula (b1) that satisfies the requirements (a) and (b), a grease composition having excellent low-temperature characteristics is easily obtained.

The values of X, Y, and Z can be calculated from the molar equivalent of each amine used as a raw material.

Examples of the monovalent saturated chain hydrocarbon group include a linear or branched alkyl group having 6 to 24 carbon atoms, and specific examples thereof include a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, an octadecenyl group, a nonadecyl group, and an icosyl group.

Examples of the monovalent unsaturated chain hydrocarbon group include a linear or branched alkenyl group having 6 to 24 carbon atoms, and specific examples thereof include a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, an icosenyl group, an oleyl group, a geranyl group, a farnesyl group, and a linoleyl group.

The monovalent saturated chain hydrocarbon group and the monovalent unsaturated chain hydrocarbon group each may be a linear chain or a branched chain.

Examples of the monovalent saturated alicyclic hydrocarbon group include a cycloalkyl group, such as a cyclohexyl group, a cycloheptyl group, a cyclooctyl group, and a cyclononyl group; and a cycloalkyl group substituted with an alkyl group having 1 to 6 carbon atoms (preferably a cyclohexyl group substituted with an alkyl group having 1 to 6 carbon atoms), such as a methylcyclohexyl group, a dimethylcyclohexyl group, an ethylcyclohexyl group, a diethylcyclohexyl group, a propylcyclohexyl group, an isopropylcyclohexyl group, a 1-methyl-propylcyclohexyl group, butylcyclohexyl group, a pentylcyclohexyl group, a pentyl-methylcyclohexyl group, and a hexylcyclohexyl group.

Examples of the monovalent unsaturated alicyclic hydrocarbon group include a cycloalkenyl group, such as a cyclohexenyl group, a cycloheptenyl group, and a cyclooctenyl group; and a cycloalkenyl group substituted with an alkyl group having 1 to 6 carbon atoms (preferably a cyclohexenyl group substituted with an alkyl group having 1 to 6 carbon atoms), such as a methylcyclohexenyl group, a dimethylcyclohexenyl group, an ethylcyclohexenyl group, a diethylcyclohexenyl group, and a propylcyclohexenyl group.

Examples of the monovalent aromatic hydrocarbon group include a phenyl group, a biphenyl group, a terphenyl group, a naphthyl group, a diphenylmethyl group, a diphenylethyl group, a diphenylpropyl group, a methylphenyl group, a dimethylphenyl group, an ethylphenyl group, and a propylphenyl group.

Although the carbon number of the divalent aromatic hydrocarbon group which can be selected as $R^3$ in the general formula (b1) is 6 to 18, it is preferably 6 to 15, and more preferably 6 to 13.

Examples of the divalent aromatic hydrocarbon group which can be selected as $R^3$ include a phenylene group, a diphenylmethylene group, a diphenylethylene group, a diphenylpropylene group, a methylphenylene group, a dimethylphenylene group, and an ethylphenylene group.

Of these, a phenylene group, a diphenylmethylene group, a diphenylethylene group, or a diphenylpropylene group is preferred, and a diphenylmethylene group is more preferred.

In the grease composition according to one embodiment of the present invention, the content of the component (B) is preferably 1.0 to 20.0% by mass, more preferably 1.5 to 15.0% by mass, still more preferably 2.0 to 13.0% by mass, even more preferably 2.5 to 10.0% by mass, and yet still more preferably 4.0% by mass to 9.0% by mass, based on the total amount (100% by mass) of the grease composition.

When the content of the component (B) is 1.0% by mass or more, it is easy to adjust the worked penetration of the obtained grease composition to an appropriate range.

On the other hand, when the content of the component (B) is 20.0% by mass or less, the obtained grease composition can be adjusted to be soft, and thus the lubricity is easily made favorable, and the wear resistance is easily improved.

<Production Method for Urea-Based Thickener (B)>

The urea-based thickener (B) can be produced generally by reacting an isocyanate compound and a monoamine. The reaction is preferably carried out by adding a solution β obtained by dissolving the monoamine in the base oil (A) to a heated solution α obtained by dissolving the isocyanate compound in the base oil (A).

For example, in the case where a compound represented by the general formula (b1) is produced, a diisocyanate having a group that corresponds to the divalent aromatic hydrocarbon group represented by $R^3$ in the general formula (b1) is used as an isocyanate compound and an amine having a group that corresponds to the monovalent hydrocarbon group represented by $R^1$ and $R^2$ is used as a monoamine, and according to the above-mentioned method, a desired urea-based thickener (B) is synthesized.

In addition, from the viewpoint of micronizing the urea-based thickener (B) in the grease composition so as to satisfy the above requirement (I) and further the above requirement (II), it is preferred to produce a grease composition containing the component (A) and the component (B) using a grease manufacturing apparatus as shown in the following [1].

[1] A grease manufacturing apparatus including a container body having an introduction portion into which a grease raw material is introduced and a discharge portion for discharging the grease into the outside; and a rotor having a rotation axis in an axial direction of the inner periphery of the container body and rotatably provided in the inside of the container body, the rotor including a first concave-convex portion in which (i) concave and convex are alternately provided along the surface of the rotor, the concave and convex being inclined to the rotation axis, and (ii) a feeding ability from the introduction portion to a direction of the discharge portion is provided.

Hereinafter, the grease manufacturing apparatus as set forth in the above-described [1] will be described, but the definition of "preferred" in the following description is an embodiment from the viewpoint of micronizing the urea-based thickener (B) in the grease composition so as to satisfy the above-described requirement (I) and further satisfy the above-described requirement (II), unless particularly noted.

FIG. 1 is a schematic cross-sectional view of the grease manufacturing apparatus as set forth in the above [1] that can be used in one embodiment of the present invention.

A grease manufacturing apparatus 1 shown in FIG. 1 includes a container body 2 for introducing a grease raw material into the inside thereof; and a rotor 3 having a rotation axis 12 on a central axis line of an inner periphery of the container body 2 and rotating around the rotation axis 12 as a center axis.

The rotor 3 rotates at high speed around the rotation axis 12 as a center axis to apply a high shearing force to a grease raw material inside the container body 2. Thus, the grease containing the urea-based thickener (B) is produced.

As shown in FIG. 1, the container body 2 is preferably partitioned to an introduction portion 4, a retention portion 5, a first inner peripheral surface 6, a second inner peripheral surface 7, and a discharge portion 8 in this order from an upstream side.

As shown in FIG. 1, it is preferred that the container body 2 has an inner peripheral surface forming such a truncated cone shape that an inner diameter thereof gradually increases from the introduction portion 4 toward the discharge portion 8.

The introduction portion 4 serving as one end of the container body 2 is provided with a plurality of solution introducing pipes 4A and 4B for introducing a grease raw material from the outside of the container body 2.

The retention portion 5 is disposed in a downstream portion of the introduction portion 4, and is a space for temporarily retaining the grease raw material introduced from the introduction portion 4. When the grease raw material is retained in the retention portion 5 for a long time, grease adhered to the inner peripheral surface of the retention portion 5 forms a large lump, so that it is preferred to transport the grease raw material to the first inner peripheral surface 6 in the downstream side in a short time as far as possible. More preferably, it is preferred to transport the grease raw material directly to the first inner peripheral surface 6 without passing through the retention portion 5.

The first inner peripheral surface 6 is disposed in a downstream portion adjacent to the retention portion 5, and the second inner peripheral surface 7 is disposed in a downstream portion adjacent to the first inner peripheral surface 6. As mentioned later in detail, it is preferred to provide a first concave-convex portion 9 on the first inner peripheral surface 6 and to provide a second concave-convex portion 10 on the second inner peripheral surface 7, for the purpose of allowing the first inner peripheral surface 6 and the second inner peripheral surface 7 to function as a high shearing portion for imparting a high shearing force to the grease raw material or grease.

The discharge portion 8 serving as the other end of the container body 2 is a part for discharging the grease stirred on the first inner peripheral surface 6 and the second inner peripheral surface 7, and is provided with a discharge port 11 for discharging grease. The discharge port 11 is formed in a direction orthogonal or approximately orthogonal to the rotation axis 12. According to this, the grease is discharged from the discharge port 11 to the direction orthogonal or approximately orthogonal to the rotation axis 12. However, the discharge port 11 does not necessarily have to be made orthogonal to the rotation axis 12, and may be formed in a direction parallel or approximately parallel to the rotation axis 12.

The rotor 3 is rotatably provided on the center axis line of the inner peripheral surface of the container body 2, which has a truncated cone shape, as a rotation axis 12, and rotates counterclockwise when the container body 2 is viewed from the upstream portion to the downstream portion as shown in FIG. 1.

The rotor 3 has an outer peripheral surface that expands in accordance with the enlargement of the inner diameter of the truncated cone of the container body 2, and the outer peripheral surface of the rotor 3 and the inner peripheral surface of the truncated cone of the container body 2 are maintained at a constant interval.

On the outer peripheral surface of the rotor 3, a first concave-convex portion 13 of the rotor in which concave and convex are alternately provided along the surface of the rotor 3 is provided.

The first concave-convex portion 13 of the rotor is inclined to the rotation axis 12 of the rotor 3 in the direction of from the introduction portion 4 to the discharge portion 8, and has a feeding ability in the direction of from the introduction portion 4 to the discharge portion 8. That is, the first concave-convex portion 13 of the rotor is inclined in the direction in which the solution is pushed toward the downstream side when the rotor 3 rotates in the direction shown in FIG. 1.

A step difference between a concave portion 13A and a convex portion 13B of the first concave-convex portion 13 of the rotor is preferably 0.3 to 30, more preferably 0.5 to 15, and still more preferably 2 to 7, when the diameter of the concave portion 13A on the outer peripheral surface of the rotor 3 is 100.

The number of convex portions 13B of the first concave-convex portion 13 of the rotor in the circumferential direction is preferably 2 to 1,000, more preferably 6 to 500, and still more preferably 12 to 200.

A ratio of the width of the convex portion 13B to the width of the concave portion 13A of the first concave-convex portion 13 of the rotor [(width of the convex portion)/(width of the concave portion)] in the cross section orthogonal to the rotation axis 12 of the rotor 3 is preferably 0.01 to 100, more preferably 0.1 to 10, and still more preferably 0.5 to 2.

An inclination angle of the first concave-convex portion 13 of the rotor with respect to the rotation axis 12 is preferably 2° to 85°, more preferably 3° to 45°, and still more preferably 5° to 20°.

It is preferred that the first inner peripheral surface 6 of the container body 2 is provided with the first concave-convex portion 9 formed with a plurality of concave and convex along the inner peripheral surface thereof.

Further, it is preferred that the concave and convex of the first concave-convex portion 9 on the side of the container body 2 are inclined in the opposite direction to the first concave-convex portion 13 of the rotor.

That is, it is preferred that the plurality of concave and convex of the first concave-convex portion 9 on the side of the container body 2 be inclined in the direction in which the solution is pushed toward the downstream side when the rotation axis 12 of the rotor 3 rotates in the direction shown in FIG. 1. The stirring ability and the discharge ability are further enhanced by the first concave-convex portion 9 having a plurality of concave and convex provided on the first inner peripheral surface 6 of the container body 2.

A depth of the concave and convex of the first concave-convex portion 9 on the side of the container body 2 is preferably 0.2 to 30, more preferably 0.5 to 15, and still more preferably 1 to 5, when the inner diameter (diameter) of the container is set to 100.

The number of concave and convex of the first concave-convex portion 9 on the side of the container body 2 is preferably 2 to 1,000, more preferably 6 to 500, and still more preferably 12 to 200.

A ratio of the width of the concave portion to the width of the convex portion between grooves in the concave and convex of the first concave-convex portion 9 on the side of the container body 2 [(width of the concave portion)/(width of the convex portion)] is preferably 0.01 to 100, more preferably 0.1 to 10, and still more preferably 0.5 to 2 or less.

An inclination angle of the concave and convex of the first concave-convex portion 9 on the side of the container body 2 to the rotation axis 12 is preferably 2 to 85°, more preferably 3 to 45°, and still more preferably 5 to 20°.

By providing the first concave-convex portion 9 on the first inner peripheral surface 6 of the container body 2, the first inner peripheral surface 6 can be made to function as a shearing portion for imparting a high shearing force to the grease raw material or grease, but the first concave-convex portion 9 does not necessarily have to be provided.

It is preferred that a second concave-convex portion 14 of a rotor having concave and convex alternately provided along the surface of the rotor 3 is provided on the outer peripheral surface of the downstream portion of the first concave-convex portion 13 of the rotor.

The second concave-convex portion 14 of the rotor is inclined to the rotation axis 12 of the rotor 3, and has a feeding suppression ability to push the solution back toward the upstream side from the introduction portion 4 toward the discharge portion 8.

A step difference of the second concave-convex portion 14 of the rotor is preferably 0.3 to 30, more preferably 0.5 to 15, and still more preferably 2 to 7, when the diameter of the concave portion of the outer peripheral surface of the rotor 3 is set to 100.

The number of convex portions of the second concave-convex portion 14 of the rotor in the circumferential direction is preferably 2 to 1,000, more preferably 6 to 500, and still more preferably 12 to 200.

A ratio of the width of the convex portion to the width of the concave portion of the second concave-convex portion 14 of the rotor in a cross section orthogonal to the rotation axis of the rotor 3 [(width of the convex portion)/(width of the concave portion)] is preferably 0.01 to 100, more preferably 0.1 to 10, and still more preferably 0.5 to 2.

An inclination angle of the second concave-convex portion 14 of the rotor to the rotation axis 12 is preferably 2° to 85°, more preferably 3° to 45°, and still more preferably 5° to 20°.

It is preferred that the second inner peripheral surface 7 of the container body 2 is provided with the second concave-convex portion 10 formed with a plurality of concave and convex adjacent to the downstream portion of the concave and convex in the first concave-convex portion 9 on the side of the container body 2.

It is preferred that the plurality of concave and convex are formed on the inner peripheral surface of the container body 2, and that the concave and convex are inclined in opposite directions to the inclination direction of the second concave-convex portion 14 of the rotor.

That is, it is preferred that the plurality of concave and convex of the second concave-convex portion 10 on the side of the container body 2 are inclined in the direction in which the solution is pushed back toward the upstream side when the rotation axis 12 of the rotor 3 rotates in the direction shown in FIG. 1. A stirring ability is more enhanced by the concave and convex of the second concave-convex portion 10 provided on the second inner peripheral surface 7 of the container body 2. In addition, the second inner peripheral surface 7 of the container body can function as a shearing portion which imparts a high shearing force to the grease raw material or grease.

A depth of the concave portion of the second concave-convex portion 10 on the side of the container body 2 is preferably 0.2 to 30, more preferably 0.5 to 15, and still more preferably 1 to 5, when the inner diameter (diameter) of the container body 2 is set to 100.

The number of concave portions of the second concave-convex portion 10 on the side of the container body 2 is preferably 2 to 1,000, more preferably 6 to 500, and still more preferably 12 to 200.

A ratio of the width of the convex portion of the concave and convex of the second concave-convex portion 10 on the side of the container body 2 to the width of the concave portion in the cross section orthogonal to the rotation axis 12 of the rotor 3 [(width of the convex portion)/(width of the concave portion)] is preferably 0.01 to 100, more preferably 0.1 to 10, and still more preferably 0.5 to 2 or less.

An inclination angle of the second concave-convex portion 10 on the side of the container body 2 to the rotation axis 12 is preferably 2° to 85°, more preferably 3° to 45°, and still more preferably 5° to 20°.

A ratio of the length of the first concave-convex portion 9 on the side of the container body 2 to the length of the second concave-convex portion 10 on the side of the container body 2 [(length of the first concave-convex portion)/(length of the second concave-convex portion)] is preferably 2/1 to 20/1.

Figure 2:
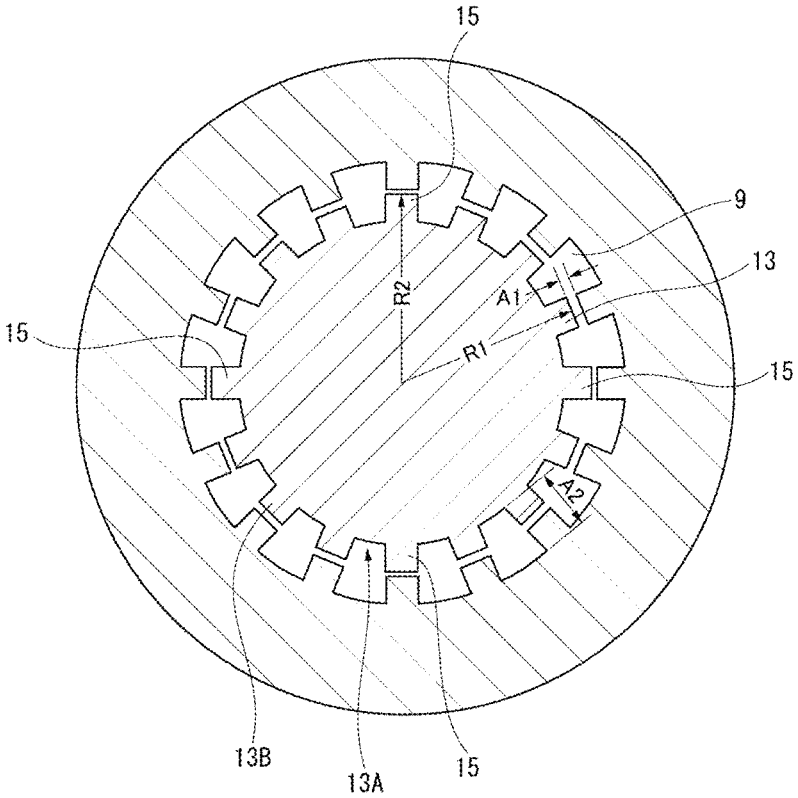
FIG. 2 is a schematic view of a cross section in the direction orthogonal to a rotation axis in a first concave-convex portion on the side of a container body of the grease manufacturing apparatus of FIG. 1.

FIG. 2 is a cross-sectional view of the direction orthogonal to the rotation axis 12 in the first concave-convex portion 9 on the side of the container body 2 of the grease manufacturing apparatus 1.

In the first concave-convex portion 13 of the rotor shown in FIG. 2, a plurality of scrapers 15 each having a tip protruding toward the inner peripheral surface side of the container body 2 beyond the tip in the projecting direction of the convex portion 13B of the first concave-convex portion 13 are provided. In addition, though not shown, the second concave-convex portion 14 is also provided with a plurality of scrapers in which the tip of the convex portion protrudes toward the inner peripheral surface side of the container body 2, similarly to the first concave-convex portion 13.

The scraper 15 scrapes off the grease adhered to the inner peripheral surface of the first concave-convex portion 9 on the side of the container body 2 and the second concave-convex portion 10 on the side of the container body 2.

With respect to the protrusion amount of the tip of the scraper 15 relative to the projecting amount of the convex portion 13B of the first concave-convex portion 13 of the rotor, a ratio [$R^2/R^1$] of the radius ($R^2$) of the tip of the scraper 15 to the radius ($R^1$) of the tip of the convex portion 13B is preferably more than 1.005 and less than 2.0.

The number of scrapers 15 is preferably 2 to 500, more preferably 2 to 50, and still more preferably 2 to 10.

In the grease manufacturing apparatus 1 shown in FIG. 2, the scraper 15 is provided, but the scraper 15 may not be provided, or the scraper 15 may be provided intermittently.

In order to produce the grease containing the urea-based thickener (B) by the grease manufacturing apparatus 1, the solution α and the solution β which are the aforementioned grease raw materials are introduced respectively from the solution introducing pipes 4A and 4B of the introduction portion 4 of the container body 2, and the rotor 3 is rotated at a high speed, whereby the grease base material containing the urea-based thickener (B) can be produced.

Then, even when a sulfur-phosphorus-based extreme pressure agent (C) and other additive (D) are blended into the grease base material thus obtained, the urea-based thickener (B) in the grease composition can be micronized so as to satisfy the requirement (I) and further the requirement (II).

As a high-speed rotation condition of the rotor 3, a shear rate applied to the grease raw material is preferably $10^2$ $s^{-1}$ or more, more preferably $10^3$ $s^{-1}$ or more, and still more preferably $10^4$ $s^{-1}$ or more, and it is typically $10^7$ $s^{-1}$ or less.

A ratio of a maximum shear rate (Max) to a minimum shear rate (Min) in the shearing at the time of high-speed rotation of the rotor 3 (Max/Min) is preferably 100 or less, more preferably 50 or less, and still more preferably 10 or less.

The shear rate to the mixed solution is as uniform as possible, thereby the urea-based thickener (B) and a precursor thereof in the grease composition can be more readily micronized, and a more uniform grease structure can be thus obtained.

Here, the maximum shear rate (Max) is a highest shear rate applied to the mixed solution, and the minimum shear rate (Min) is a lowest shear rate applied to the mixed solution, which are defined as follows.

Maximum shear rate (Max)=(linear velocity at the tip of the convex portion 13*B* of the first concave-convex portion 13 of the rotor)/(gap *A*1 between the tip of the convex portion 13*B* of the first concave-convex portion 13 of the rotor and the convex portion of the first concave-convex portion 9 of the first inner peripheral surface 6 of the container body 2)

Minimum shear rate (Min)=(linear velocity of the concave portion 13*A* of the first concave-convex portion 13 of the rotor)/(gap *A*2 between the concave portion 13*A* of the first concave-convex portion 13 of the rotor and the concave portion of the first concave-convex portion 9 on the first inner peripheral surface 6 of the container body 2)

The gap A1 and the gap A2 are as shown in FIG. 2.

The grease manufacturing apparatus 1 is provided with the scraper 15, thereby grease adhered to the inner peripheral surface of the container body 2 can be scraped off, so that the generation of the lumps during kneading can be prevented, and the grease in which the urea-based thickener (B) is micronized can be continuously produced in a short time.

Further, in view of the fact that the scraper 15 scrapes off the grease adhered thereto, it is possible to prevent the retained grease from becoming a resistance to rotation of the rotor 3, so that the rotational torque of the rotor 3 can be reduced, and the power consumption of the drive source can be reduced, thereby making it possible to continuously produce the grease efficiently.

Since the inner peripheral surface of the container body 2 is in a shape of a truncated cone whose inner diameter increases from the introduction portion 4 toward the discharge portion 8, the centrifugal force has an effect for discharging the grease or grease raw material in the downstream direction, and the rotation torque of the rotor 3 can be reduced to continuously produce the grease.

Since the first concave-convex portion 13 of the rotor is provided on an outer peripheral surface of the rotor 3, the first concave-convex portion 13 of the rotor is inclined to the rotation axis 12 of the rotor 3, the first concave-convex portion 13 has a feeding ability from the introduction portion 4 to the discharge portion 8, the second concave-convex portion 14 of the rotor is inclined to the rotation axis 12 of the rotor 3, and the second concave-convex portion 14 has a feeding suppression ability from the introduction portion 4 to the discharge portion 8, a high shear force can be given to the solution, and even after blending with the additive, the urea-based thickener (B) in the grease composition can be micronized so as to satisfy the above requirement (I) and further the above requirement (II).

Since the first concave-convex portion 9 is formed on the first inner peripheral surface 6 of the container body 2 and is inclined in the opposite direction to the first concave-convex portion 13 of the rotor, in addition to the effect of the first concave-convex portion 13 of the rotor, sufficient stirring of grease raw material can be carried out while extruding the grease or grease raw material in the downstream direction, and even after the additives are blended, it is possible to micronize the urea-based thickener (B) in the grease composition so as to satisfy the above requirement (I) and further the above requirement (II).

Further, since the second concave-convex portion 10 is provided on the second inner peripheral surface 7 of the container body 2 and the second concave-convex portion 14 of the rotor is provided on the outer peripheral surface of the rotor 3, it is possible to prevent the grease raw material from flowing out from the first inner peripheral surface 6 of the container body more than necessary. Therefore, even after the additive is blended by highly dispersing the grease raw material by giving a high shearing force to the solution, the urea-based thickener (B) can be micronized so as to satisfy the above requirement (I) and further the above requirement (II).

<Melamine Cyanurate (C)>

The grease composition of the present invention contains melamine cyanurate (C) together with the component (A) and the component (B).

When the grease composition of the present invention contains melamine cyanurate (C), it is possible to obtain a grease composition having excellent wear resistance.

Melamine cyanurate is an organic salt composed of melamine and cyanuric acid, and has a graphite structure.

The particle diameter of the melamine cyanurate (C) is preferably 5.0 μm or less, more preferably 4.0 μm or less, still more preferably 3.0 μm or less, even more preferably 2.5 μm or less, and yet still more preferably 2.0 μm or less. The lower limit of the particle diameter of the melamine cyanurate (C) is not particularly limited, but is usually 0.005 μm or more.

As the particle diameter of the melamine cyanurate (C) is smaller, the melamine cyanurate (C), which is a solid lubricant, is more likely to enter defects generated on the surface of the resin material with which the grease composition is in contact, and the melamine cyanurate (C) fills the defects. Therefore, even when a high load is applied to the resin material for a long period of time, the progress of the defects of the resin material is suppressed, and the amount of wear can be reduced. Therefore, it is preferred that the particle diameter of the melamine cyanurate (C) is as small as possible.

In the description herein, the particle diameter of melamine cyanurate (C) means an average particle diameter measured by the following method. In addition, the particle diameter of the melamine cyanurate (C) alone is maintained at the same particle diameter even in the grease composition. (That is, the particle diameter of the melamine cyanurate (C) contained in the grease composition is at the same level as the particle diameter of the melamine cyanurate (C) itself.)

[Particle Diameter of Melamine Cyanurate (C)]

As the particle diameter (average particle size) of the melamine cyanurate (C), it was measured at 25° C. by a dynamic light scattering method (photon-correlation method), and 50% particle size (volume median particle size, $D_{50}$) based on the scattering intensity, which was calculated from the dispersed particle size distribution analyzed by the CONTIN method, can be used.

In the grease composition of the present invention, the content of the melamine cyanurate (C) is preferably 0.2% by mass or more, more preferably 0.3% by mass or more, and still more preferably 0.5% by mass or more, based on the total amount (100% by mass) of the grease composition, from the viewpoint of wear resistance. On the other hand, in the grease composition of the present invention, the content of the melamine cyanurate (C) is preferably 10.0% by mass or less, more preferably 5.0% by mass or less, still more preferably 3.0% by mass or less, and even more preferably 2.0% by mass or less, based on the total amount (100% by mass) of the grease composition, from the viewpoint of reducing the amount of wear.

The content ratio [(B)/(C)] of the urea-based thickener (B) to the melamine cyanurate (C) is, in terms of mass ratio, preferably 1.0 to 18.0, more preferably 3.0 to 15.0, and still more preferably 5.0 to 12.0, from the viewpoint of wear resistance.

<Oily Agent (D)>

The grease composition of the present invention preferably contains an oily agent (D) together with the component (A), the component (B), and the component (C).

When the grease composition according to one embodiment of the present invention contains the oily agent (D), the grease composition can have a further reduced friction coefficient.

As the oily agent (D), for example, at least one or more selected from a sarcosine derivative (D1), an amine compound (D2), a polyamide compound (D3), and an ether compound (D4) is preferred. These may be used alone or may be used in combination of two or more thereof.

<<Sarcosine Derivative (D1)>>

The sarcosine derivative (D1) is an α-amino acid in which a secondary or tertiary amino group having a methyl group is bonded to a carbon atom to which a carboxy group is bonded, and may be N-methylglycine or an aliphatic amino acid having an N-methylglycine skeleton.

Examples of the sarcosine derivative (D1) include N-oleoylsarcosine, N-methyl-oleylsarcosine, N-methyl-stearylsarcosine, N-octyl-oleylsarcosine, N-lauryl-oleylsarcosine, and N-lauryl-stearylsarcosine. Among these, N-oleoylsarcosine is preferred.

These sarcosine derivatives (D1) may be used alone or may be used in combination of two or more thereof.

The sarcosine derivative (D1) used in one embodiment of the present invention is preferably a compound represented by the following general formula (d-1).

(d-1)

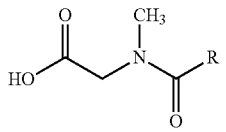

In the general formula (d-1), R is an alkyl group having 1 to 30 carbon atoms or an alkenyl group having 1 to 30 carbon atoms.

Although the carbon number of the alkyl group and the alkenyl group is 1 to 30, it is preferably 6 to 27, more preferably 10 to 24, and still preferably 12 to 20.

The alkyl group may be a linear alkyl group or may be a branched alkyl group.

Also, the alkenyl group may be a linear alkenyl group or may be a branched alkenyl group.

<<Amine Compound (D2)>>

The amine compound (D2) may be a compound having an amino group, and examples thereof include a monoamine, a diamine, and a triamine.

The amine compound (D2) may be used alone or may be used in combination of two or more thereof.

Among these, as the amine compound (D2) used in one embodiment of the present invention, a monoamine is preferred, and an aliphatic monoamine is more preferred.

Examples of the aliphatic monoamine used in one embodiment of the present invention include a primary aliphatic monoamine represented by the following general formula (d2-i), a secondary aliphatic monoamine represented by the following general formula (d2-ii), and a tertiary aliphatic monoamine represented by the following general formula (d2-iii).

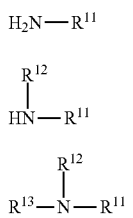

(d2-i)

(d2-ii)

(d2-iii)

In the general formulae (d2-i) to (d2-iii), $R^{11}$ to $R^{13}$ are each independently an alkyl group or an alkenyl group, and preferably an alkenyl group.

The carbon number of the alkyl group and the alkenyl group which can be selected as $R^{11}$ to $R^{13}$ is preferably 8 to 22, more preferably 10 to 20, and still preferably 12 to 18.

The alkyl group may be a linear alkyl group or may be a branched alkyl group.

Also, the alkenyl group may be a linear alkenyl group or may be a branched alkenyl group.

Examples of the primary aliphatic monoamine represented by the general formula (d2-i) include octylamine, laurylamine, stearylamine, and oleylamine. Of these, oleylamine is preferred.

Examples of the secondary aliphatic monoamine represented by the general formula (d2-ii) include dioctylamine, dilaurylamine, distearylamine, and dioleylamine.

Examples of the tertiary aliphatic monoamine represented by the general formula (d2-iii) include trioctylamine, trilaurylamine, tristearylamine, and trioleylamine.

The amine compound (D2) which is used in one embodiment of the present invention is preferably the primary aliphatic monoamine represented by the general formula (d2-i), and more preferably the primary aliphatic monoamine represented by the general formula (i) wherein $R^1$ is an alkenyl group having 8 to 22 carbon atoms.

<<Polyamide Compound (D3)>>

The polyamide compound (D3) may be any compound having a plurality of amide bonds, but is preferably an acid amide obtained by reacting a carboxylic acid with an amine, and more preferably a fatty acid amide obtained by reacting a fatty acid with an amine.

The polyamide compound (D3) may be used alone or in combination of two or more thereof.

As the carboxylic acid, there is exemplified a linear or branched, saturated or unsaturated monocarboxylic acid. Specifically, examples thereof include a saturated fatty acid, such as heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, isostearic acid, nonadecanoic acid, eicosanoic acid, heneicosanoic acid, docosanoic acid, tricosanoic acid, and tetracosanoic acid; and an unsaturated fatty acid, such as heptenoic acid, octenoic acid, nonenoic acid, decenoic acid, undecenoic acid, dodecenoic acid, tridecenoic acid, tetradecenoic acid, pentadecenoic acid, hexadecenoic acid, heptadecenoic acid, octadecenoic acid (inclusive of oleic acid), nonadecenoic acid, eicosenoic acid, heneicosenoic acid, docosenoic acid, tricosenoic acid, and tetracosenoic acid. Of these, isostearic acid is preferred.

The saturated fatty acid and the unsaturated fatty acid each may be of a linear chain or a branched chain.

In addition, the position of the double bond of the unsaturated fatty acid is arbitrary.

The carbon number of the carboxylic acid is preferably 7 to 30, more preferably 8 to 24, and still more preferably 10 to 22.

Examples of the amine include an alkylamine, an alkanolamine, and a polyalkylene polyamine. Of these, a polyalkylene polyamine is preferred.

Examples of the alkylamine include a primary aliphatic alkylamine, such as monomethylamine, monoethylamine, monopropylamine, monobutylamine, monopentylamine, monohexylamine, and monoheptylamine; and a secondary aliphatic alkylamine, such as dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, and diheptylamine.

The alkyl group contained in the alkylamine may be either linear or branched.

Examples of the alkanolamine include monomethanolamine, monoethanolamine, monopropanolamine, monobutanolamine, monohexanolamine, monopentanolamine, dimethanolamine, diethanolamine, methanolethanolamine, methanolpropanolamine, dipropanolamine, ethanolpropanolamine, methanolbutanolamine, ethanolbutanolamine, propanolbutanolamine, dibutanolamine, dipentanolamine, and dihexanolamine.

The alkanol group contained in the alkanolamine may be either linear or branched.

Examples of the polyalkylenepolyamine include diethylenetriamine, triethylenetetramine, tetraethylenepentamine, pentaethylenehexamine, hexaethyleneheptamine, tetrapropylenepentamine, and hexabutyleneheptamine. Of these, tetraethylenepentamine is preferred.

<<Ether Compound (D4)>>

The ether compound (D4) may be a compound having an ether bond, and examples thereof include an aliphatic ether.

Examples of the aliphatic ether include a monoalkyl glyceryl ether.

The carbon number of the alkyl group contained in the monoalkyl glyceryl ether is preferably 1 to 20, and more preferably 4 to 10. The alkyl group contained in the monoalkyl glyceryl ether may be linear or may have a branched chain.

Examples of the alkyl group contained in the monoalkyl glyceryl ether include a methyl group, an ethyl group, a propyl group, a n-butyl group, an isobutyl group, a n-pentyl group, a 2-methylbutyl group, an isopentyl group, a n-hexyl group, an isohexyl group, a n-heptyl group, a n-octyl group, a 2-ethylhexyl group, a n-decyl group, and an isodecyl group.

Examples of the monoalkyl glyceryl ether include 1-methyl glyceryl ether, 2-methyl glyceryl ether, 1-ethyl glyceryl ether, 1-pentyl glyceryl ether, 2-pentyl glyceryl ether, and 1-octyl glyceryl ether.

In the grease composition of the present invention, the content of the oily agent (D) is preferably 0.1 to 5.0% by mass, more preferably 0.5 to 3.0% by mass, and still more preferably 0.8 to 1.5% by mass based on the total amount (100% by mass) of the grease composition from the viewpoint of reducing the friction coefficient.

The content ratio [(C)/(D)] of the melamine cyanurate (C) to the oily agent (D) is, in terms of mass ratio, preferably 0.3 to 3.0, more preferably 0.4 to 2.0, and still more preferably 0.6 to 1.5, from the viewpoint of wear resistance and friction characteristics.

<Anti-Wear Agent (E)>

The grease composition of the present invention preferably contains an anti-wear agent (E) together with the component (A), the component (B), and the component (C).

When the grease composition according to one embodiment of the present invention contains the anti-wear agent (E), the grease composition can have further improved wear resistance.

Examples of the anti-wear agent (E) include at least one or more selected from an ester compound (E1) and a bisamide compound (E2). These may be used alone or may be used in combination of two or more thereof.

The ester compound (E1) is not particularly limited, and examples thereof include a fatty acid ester.

The fatty acid constituting the fatty acid ester may be a saturated fatty acid or an unsaturated fatty acid.

The carbon number of the fatty acid constituting the fatty acid ester is preferably 10 to 24, more preferably 12 to 22, and still more preferably 16 to 20.

The fatty acid ester is not particularly limited, and examples thereof include methyl stearate, methyl laurate, methyl myristate, methyl palmitate, methyl oleate, methyl erucate, methyl behenate, butyl laurate, butyl stearate, isopropyl myristate, isopropyl palmitate, and octyl palmitate. These may be used alone or may be used in combination of two or more thereof. Of these, methyl stearate is preferred.

The bisamide compound (E2) is not particularly limited, and examples thereof include a fatty acid bisamide.

The fatty acid bisamide is not particularly limited, and examples thereof include ethylenebis stearic acid amide, methylenebis caprylic acid amide, methylenebis capric acid amide, methylenebis lauric acid amide, methylenebis myristic acid amide, methylenebis palmitic acid amide, methylenebis stearic acid amide, methylenebis isostearic acid amide, methylenebis behenic acid amide, methylenebis oleic acid amide, methylenebis erucic acid amide, ethylenebis caprylic acid amide, ethylenebis capric acid amide, ethylenebis lauric acid amide, ethylenebis myristic acid amide, ethylenebis palmitic acid amide, ethylenebis isostearic acid amide, ethylenebis behenic acid amide, ethylenebis oleic acid amide, ethylenebis erucic acid amide, butylenebis stearic acid amide, butylenebis behenic acid amide, butylenebis oleic acid amide, butylenebis erucic acid amide, hexamethylenebis stearic acid amide, hexamethylenebis behenic acid amide, hexamethylenebis oleic acid amide, hexamethylenebis erucic acid amide, m-xylylenebis stearic acid amide, m-xylylenebis-12-hydroxystearic acid amide, p-xylylenebis stearic acid amide, p-phenylenebis stearic acid amide, methylenebis hydroxystearic acid amide, ethylenebis hydroxystearic acid amide, butylenebis hydroxystearic acid amide, and hexamethylenebis hydroxystearic acid amide. These may be used alone or may be used in combination of two or more thereof. Of these, ethylenebis stearic acid amide is preferred.

The content ratio [(C)/(E)] of the melamine cyanurate (C) to the anti-wear agent (E) is, in terms of mass ratio, preferably 0.1 to 2.0, more preferably 0.2 to 1.0, and still more preferably 0.3 to 0.5, from the viewpoint of wear resistance.

<Friction Reducing Agent (F)>

The grease composition of the present invention preferably contains a friction reducing agent (F) together with the component (A), the component (B), and the component (C).

When the grease composition according to one embodiment of the present invention contains the friction reducing agent (F), the friction characteristics of the grease composition can be further improved.

Examples of the friction reducing agent (F) include a polymer compound (F1).

Examples of the polymer compound (F1) include polymers such as non-dispersed poly(meth)acrylates, dispersed poly(meth)acrylates, star polymers, olefin-based copolymers, dispersed olefin-based copolymers, polyalkylstyrenes, and styrene-based copolymers.

Examples of the olefin-based copolymer include an ethylene-propylene copolymer and an ethylene-butylene copolymer.

Examples of the styrene-based copolymer include a styrene-diene copolymer and a styrene-isoprene copolymer.

These may be used alone or may be used in combination of two or more thereof. Moreover, these may be any of a random copolymer and a block copolymer.

Among these, an ethylene-propylene copolymer and an ethylene-butylene copolymer are preferred.

The mass average molecular weight (Mw) of the polymer compound (F1) is preferably 50,000 or more, and more preferably 100,000 or more from the viewpoint of wear resistance. On the other hand, the mass average molecular weight (Mw) of the polymer compound (F1) is preferably 1,000,000 or less from the viewpoint of availability of the polymer compound.

The number average molecular weight (Mn) of the polymer compound (F1) is preferably 30,000 or more, more preferably 50,000 or more, and still more preferably 80,000 or more from the viewpoint of wear resistance. On the other hand, the number average molecular weight (Mn) of the polymer compound (F1) is preferably 500,000 or less from the viewpoint of availability of the polymer compound.

The molecular weight distribution (Mw/Mn) of the polymer compound (F1) is preferably 2.20 or less, more preferably 2.00 or less, still more preferably 1.90 or less, and even more preferably 1.85 or less, from the viewpoint of wear resistance. On the other hand, the molecular weight distribution (Mw/Mn) of the polymer compound (F1) is preferably 1.10 or more from the viewpoint of availability of the polymer compound.

The content of the polymer compound (F1) in terms of resin is preferably 0.1 to 35.0% by mass, more preferably 1.0 to 30.0% by mass, still more preferably 5.0 to 27.0% by mass, and even more preferably 8.0 to 26.0% by mass based on the total amount (100% by mass) of the grease composition from the viewpoint of reducing the friction coefficient.

<Additive (G)>

The grease composition according to one embodiment of the present invention may contain an additive (G) other than the component (B), the component (C), the component (D), the component (E), and the component (F), which are blended in a general grease, as long as the effects of the present invention are not impaired.

Examples of the additive (G) include an antioxidant, a rust inhibitor, an extreme pressure agent, a viscosity improver, a solid lubricant, a detergent dispersant, a corrosion inhibitor, and a metal deactivator.

Each of the additives (G) may be used alone, or two or more thereof may be used in combination.

Examples of the antioxidant include a phenol-based antioxidant.

Examples of the rust inhibitor include carboxylic acid-based rust inhibitors such as alkenylsuccinic acid polyhydric alcohol esters, zinc stearate, thiadiazole and derivatives thereof, and benzotriazole and derivatives thereof.

Examples of the extreme pressure agent include thiocarbamic acids such as zinc dialkyldithiophosphate, molybdenum dialkyldithiophosphate, ashless dithiocarbamate, zinc dithiocarbamate, and molybdenum dithiocarbamate; sulfur compounds such as sulfurized fats and oils, sulfurized olefins, polysulfide, thiophosphoric acids, thioterpenes, and dialkyl thiodipropionates; phosphoric acid esters such as tricresyl phosphate; and phosphite esters such as triphenyl phosphite.

Examples of the solid lubricant include polyimide, PTFE, graphite, metal oxide, boron nitride, and molybdenum disulfide.

Examples of the detergent dispersant include ashless dispersants such as succinimide and boron-based succinimide.

Examples of the corrosion inhibitor include a benzotriazole-based compound and a thiazole-based compound.

Examples of the metal deactivator include a benzotriazole-based compound.

In the grease composition according to one embodiment of the present invention, the content of these additives (G) is appropriately set according to the type of the additive, but each independently is usually 0.01 to 20% by mass, preferably 0.01 to 15% by mass, more preferably 0.01 to 10% by mass, and still more preferably 0.01 to 7% by mass based on the total amount (100% by mass) of the grease composition.

<Physical Properties of Grease Composition>

(Worked Penetration)

The worked penetration at 25° C. of the grease composition according to one embodiment of the present invention is preferably 220 to 430, more preferably 240 to 360, still more preferably 250 to 350, and even more preferably 260 to 330, from the viewpoint of obtaining excellent wear resistance.

In the description herein, the worked penetration of the grease composition means a value measured at 25° C. in accordance with JIS K 2220:2013 (item 7).

(Wear Resistance)

The wear resistance of the grease composition according to one embodiment of the present invention can be evaluated by measuring the rate of decrease in the amount of wear by the method described in Examples below.

<Method for Producing Grease Composition>

The grease composition of the present invention can be produced by mixing a base oil (A), a grease (base grease) containing a urea-based thickener (B), melamine cyanurate (C), and if necessary, an oily agent (D), an anti-wear agent (E), a friction reducing agent (F), and an additive (G).

For example, the grease composition of the present invention can be produced by mixing the base oil (A) and the grease (base grease) containing the urea-based thickener (B), and then adding the melamine cyanurate (C) and, if necessary, the oily agent (D), the anti-wear agent (E), the friction reducing agent (F), and the additive (G), followed by mixing and homogenization.

<Use of Grease Composition>

The grease composition of the present invention is excellent in wear resistance. In particular, when used for lubricating a sliding portion composed of a metal material and a resin material, the grease composition has excellent wear resistance.

Therefore, the grease composition according to one embodiment of the present invention can be suitably used for lubricating sliding portions of various apparatuses, and is particularly preferably used for lubricating an apparatus having a sliding portion composed of a metal material and a resin material.

As the metal material, various steels such as carbon steel and stainless steel, various alloys such as an aluminum alloy, and copper are preferred. The metal material may be replaced with a material having high strength (for example, a ceramic material or the like).

The resin material may be a natural resin or a synthetic resin, but is preferably a synthetic general-purpose plastic (polyethylene, polystyrene, polypropylene, polyvinyl chloride, or the like) or an engineering plastic, and more preferably an engineering plastic from the viewpoint of heat resistance and mechanical strength.

Examples of the engineering plastic include synthetic resins such as polyamide resins, polyacetal resins, polycarbonate resins, polysulfone resins, polyphenylene sulfide resins, polyamide-imide resins, polyether ether ketone resins, phenol resins, polyester resins, and epoxy resins.

The resin material is preferably a fiber reinforced resin material.

Examples of the fiber reinforced resin material include a glass fiber reinforced resin material.

Examples of the field of apparatuses in which the grease composition of the present invention can be suitably used include the field of automobiles, the field of office equipment, the field of machine tools, the field of wind turbines, the field of construction, the field of agricultural machinery, and the field of industrial robots.

Examples of the lubricating portion in an apparatus in the field of automobiles, in which the grease composition of the present invention can be suitably used, include a bearing portion in an apparatus, such as a radiator fan motor, a fan coupling, an alternator, an idler pulley, a hub unit, a water pump, a power window, a wiper, an electric power steering, an electric motor for driving with a flywheel, a ball joint, a wheel bearing, a spline portion, and a constant velocity joint; and a bearing portion, a gear portion, and a sliding portion in an apparatus, such as a door lock, a door hinge, and a clutch booster.

More specifically, examples thereof include a bearing portion such as a hub unit, an electric power steering, an electric motor for driving with a flywheel, a ball joint, a wheel bearing, a spline portion, a constant velocity joint, a clutch booster, a servomotor, a blade bearing, and a generator.

Examples of the lubricating portion in an apparatus in the field of office equipment, in which the grease composition of the present invention can be suitably used, include a fixing roll in an apparatus, such as a printer; and a bearing portion and a gear portion in an apparatus, such as a polygon motor.

Examples of the lubricating portion in an apparatus in the field of machine tools, in which the grease composition of the present invention can be suitably used, include a bearing portion in a reduction gear of a spindle, a servomotor, a machining robot, or the like.

Examples of the lubricating portion in an apparatus in the field of wind turbines, in which the grease composition of the present invention can be suitably used, include a bearing portion of a blade bearing, a generator, or the like.

Examples of the lubricating portion in an apparatus in the field of construction or agricultural machinery, in which the grease composition of the present invention can be suitably used, include a bearing portion, a gear portion, and a sliding portion of a ball joint, a spline portion, or the like, According to one embodiment of an apparatus to which the grease composition of the present invention is applicable, it is preferred that the sliding mechanism is a reduction gear (worm gear) of an electric power steering having a metal worm and a resin worm wheel. The apparatus having such a configuration is excellent in wear resistance.

[Lubricating Method of Sliding Mechanism]

A lubricating method of a sliding mechanism applicable to the grease composition of the present invention is a method of lubricating a sliding mechanism of sliding a metal material and a resin material with the above-described grease composition of the present invention.

According to the lubricating method of a sliding mechanism applicable to the grease composition of the present invention, it is possible to reduce the amount of wear in the lubricating portion. This effect is excellent in wear resistance when the sliding mechanism is a reduction gear (worm gear) of an electric power steering having a metal worm and a resin worm wheel.

According to one embodiment of the present invention, the following [1] to [16] are provided.

[1] A grease composition containing a base oil (A), a urea-based thickener (B), and melamine cyanurate (C), wherein particles containing the urea-based thickener (B) in the grease composition satisfy the following requirement (I):

Requirement (I): The particles have an area-based arithmetic average particle diameter of 2.0 μm or less, as measured by a laser diffraction/scattering method.

[2] The grease composition as set forth in [1], wherein the particles containing the urea-based thickener (B) in the grease composition further satisfy the following requirement (II):

Requirement (II): The particles have a specific surface area of $0.5\times10^5$ $cm^2/cm^3$ or more, as measured by a laser diffraction/scattering method.

[3] The grease composition as set forth in [1] or [2], wherein the content of the melamine cyanurate (C) is 0.2% by mass or more based on the total amount of the grease composition.

[4] The grease composition as set forth in any one of [1] to [3], wherein the melamine cyanurate (C) has a particle diameter of 5.0 μm or less.

[5] The grease composition as set forth in any one of [1] to [4], further containing one or more oily agents (D) selected from the group consisting of a sarcosine derivative (D1), an amine compound (D2), a polyamide compound (D3), and an ether compound (D4).

[6] The grease composition as set forth in [5], wherein a content ratio [(C)/(D)] of the content of the melamine cyanurate (C) to the content of the oily agent (D) is 0.3 to 3.0 in terms of a mass ratio.

[7] The grease composition as set forth in any one of [1] to [6], further containing one or more anti-wear agents (E) selected from the group consisting of an ester compound (E1) and a bisamide compound (E2).

[8] The grease composition as set forth in [7], wherein a content ratio [(C)/(E)] of the content of the melamine cyanurate (C) to the content of the anti-wear agent (E) is 0.1 to 2.0 in terms of a mass ratio.

[9] The grease composition as set forth in any one of [1] to [8], wherein the content of the urea-based thickener (B) is 1.0% by mass to 20.0% by mass based on the total amount of the grease composition.

[10] The grease composition as set forth in any one of [1] to [9], wherein a content ratio [(B)/(C)] of the urea-based thickener (B) to the melamine cyanurate (C) is 1.0 to 18.0 in terms of a mass ratio.

[11] The grease composition as set forth in any one of [1] to [10], wherein the base oil (A) has a 40° C. kinematic viscosity of 30 $mm^2/s$ to 200 $mm^2/s$.

[12] The grease composition as set forth in any one of [1] to [11], having a worked penetration of 260 to 330.

[13] The grease composition as set forth in any one of [1] to [12], wherein the grease composition is used for lubrication of a sliding mechanism of sliding a metal material and a resin material.

[14] The grease composition as set forth in [13], wherein the resin material is a glass fiber reinforced resin material.

[15] A lubricating method including lubricating a sliding mechanism of sliding a metal material and a resin material, by using the grease composition as set forth in any one of [1] to [12].

[16] The lubricating method as set forth in [15], wherein the resin material is a glass fiber reinforced resin material.

EXAMPLES

The present invention will be specifically described with reference to the following Examples, but the present invention is not limited to the following Examples.

[Various Physical Property Values]

The measurement methods of various physical property values were as follows.

(1) 40° C. Kinematic Viscosity and Viscosity Index of Base Oil (A)

These were measured and calculated in accordance with JIS K 2283:2000.

(2) Average Particle Diameter of Melamine Cyanurate (C)

It was measured at 25° C. by a dynamic light scattering method (photon-correlation method), and 50% particle size (volume median particle size, $D_{50}$) based on the scattering intensity, which was calculated from the dispersed particle size distribution analyzed by the CONTIN method, was used.

(3) Mass Average Molecular Weight (Mw), Number Average Molecular Weight (Mn), and Molecular Weight Distribution (Mw/Mn) of Polymer Compound (F1)

Values measured in terms of standard polystyrene according to the following measurement conditions using a gel permeation chromatograph apparatus (manufactured by Agilent Technologies Inc., apparatus name "Model 1260 HPLC") were used.

(Measurement Conditions)

Column: Two "Shodex LF404" were sequentially connected.

Column temperature: 35° C.

Developing solvent: chloroform

Flow rate: 0.3 mL/min (4) Worked Penetration of Grease Composition

The worked penetration of the grease composition was measured at 25° C. in accordance with JIS K 2220:2013 (item 7).

[Raw Materials]

The base oil (A), the melamine cyanurate (C), the oily agent (D), the anti-wear agent (E), the friction reducing agent (F), and the additive (G) used as raw materials for preparing the grease compositions in Examples 1 to 4 and Comparative Examples 1 and 2 were as follows.

In addition, the content in Table 1 is a content in terms of resin content.

<Base Oil (A)>

Base oil (A1) (poly-α-olefin (PAO), 40° C. kinematic viscosity: 30 $mm^2/s$, viscosity index: 130)

Base oil (A2) (poly-α-olefin (PAO), 40° C. kinematic viscosity: 400 $mm^2/s$, viscosity index: 150)

<Melamine Cyanurate (C)>

Melamine cyanurate (C1) (average particle diameter: about 4.5 μm)

Melamine cyanurate (C2) (average particle diameter: about 3.0 μm)

Melamine cyanurate (C3) (average particle diameter: about 1.5 μm)

<Oily Agent (D)>

Sarcosine derivative (D1): N-oleoylsarcosine

Amine compound (D2): oleylamine

Polyamide compound (D3): reaction product of isostearic acid and tetraethylenepentamine <Anti-Wear Agent (E)>

Ester compound (E1): methyl stearate

Bisamide compound (E2): ethylenebis stearic acid amide

<Friction Reducing Agent (F)>

Polymer Compound (F1): Ethylene-propylene copolymer (mass average molecular weight (Mw): 172,000, number average molecular weight (Mn): 93,500, molecular weight distribution (Mw/Mn): 1.84)

<Additive (G)>

Antioxidant: Phenol-based antioxidant

Example 1

(1) Synthesis of Urea Grease 3.25 parts by mass of diphenylmethane-4,4'-diisocyanate (MDI) was added to a mixed base oil of 13.00 parts by mass of the base oil (A1) and 26.45 parts by mass of the base oil (A2) heated to 70° C. to prepare a solution α.

1.03 parts by mass of cyclohexylamine and 4.20 parts by mass of octadecylamine (stearylamine) were added to a separately prepared mixed base oil of 13.00 parts by mass of the base oil (A1) and 25.00 parts by mass of the base oil (A2) heated to 70° C. to prepare a solution β.

Then, using the grease manufacturing apparatus 1 shown in FIG. 1, an equal amount of the solution α heated to 70° C. was simultaneously introduced into the container body 2 from the solution introduction pipe 4A, and an equal amount of the solution β heated to 70° C. was simultaneously introduced into the container body 2 from the solution introduction pipe 4B, and the solution α and the solution β were continuously introduced into the container body 2 in a state in which the rotor 3 was rotated. Thereafter, the temperature of this mixture was raised to 160° C. with a stirring apparatus, and the mixture was stirred for 1 hour and then subjected to a roll-mill treatment to be homogenized, thereby synthesizing a urea grease (b1).

The rotation speed of the rotor 3 of the grease manufacturing apparatus 1 used was set to 8,000 rpm. At this time, the stirring was performed with the maximum shearing rate (Max) being 10,500 $s^{-1}$ and the ratio [Max/Min] of the maximum shearing rate (Max) to the minimum shearing rate (Min) being 3.5.

The urea-based thickener (B1) contained in the obtained urea grease corresponds to a compound in which $R^1$ and $R^2$ in the general formula (b1) are a cyclohexyl group or an octadecyl group (a stearyl group) and $R^3$ is a diphenylmethylene group.

The molar ratio of cyclohexylamine to octadecylamine (cyclohexylamine/octadecylamine) used as raw materials was 40/60.

(2) Preparation of Grease Composition

In the above (1), the urea grease (b1) discharged from the grease manufacturing apparatus 1 shown in FIG. 1 was stirred and then cooled by natural cooling.

Next, the respective components from the melamine cyanurate (C2) to the phenol-based antioxidant shown in Table 1 were added in the blending amounts shown in Table 1 to the urea grease (b1) cooled to 25° C. by natural cooling, and mixed. Thereafter, the mixture was homogenized with a three-rollers milling machine to obtain a grease composition of Example 1.

Example 4

A grease composition of Example 4 was obtained in the same manner as in Example 1, except that, in "(1) Synthesis of Urea Grease" of Example 1, the content of each component was changed as follows.

Base oil (A1) heated to 70° C.: 30.00 parts by mass

Diphenylmethane-4,4'-diisocyanate (MDI): 4.10 parts by mass

Separately prepared base oil (A1) heated to 70° C.: 29.95 parts by mass

Cyclohexylamine: 2.60 parts by mass

Octadecylamine (stearylamine): 1.77 parts by mass

The urea-based thickener (B2) contained in the obtained urea grease corresponds to a compound in which $R^1$ and $R^2$ in the general formula (b1) are a cyclohexyl group or an octadecyl group (a stearyl group) and $R^3$ is a diphenylmethylene group.

The molar ratio of cyclohexylamine to octadecylamine (cyclohexylamine/octadecylamine) used as raw materials was 80/20.

Examples 2 and 3 and Comparative Examples 1 and 2

Each grease composition was prepared in the same manner as the grease composition described above, except that the content was changed to the content shown in Table 1.

[Requirements]

The urea greases synthesized in Examples 1 to 4 and Comparative Examples 1 and 2 were subjected to the following calculation.

(1) Calculation of Particle Diameter of Particles Containing Urea-Based Thickener: Requirement (I)

The particle diameter of the particles containing the urea-based thickener in the grease composition was evaluated. Specifically, the urea grease synthesized in Example 1 and the urea grease synthesized in Comparative Example 1 were used as measurement samples, and the particle diameter of particles containing the urea-based thickener (B) was determined by the following procedure.

First, a measurement sample was defoamed in vacuum and filled in a 1 mL syringe, 0.10 to 0.15 mL of the sample was extruded from the syringe, and the extruded sample was placed on the surface of a plate-shaped cell of a paste cell fixing jig. Next, another plate-shaped cell was stacked on the sample to obtain a measurement cell in which the sample was sandwiched between two cells. Next, the area-based arithmetic average particle diameter of the particles in the sample of the measurement cell was measured using a laser diffraction type particle size measuring instrument (trade name: LA-920, manufactured by HORIBA, Ltd.).

Here, the "area-based arithmetic average particle diameter" means a value obtained by arithmetically averaging the particle size distribution on an area basis. The particle size distribution on an area basis indicates a frequency distribution of the particle diameter in the entire particles to be measured on the basis of an area calculated from the particle diameter (specifically, a cross-sectional area of particles having the particle diameter). Further, the value obtained by arithmetically averaging the particle size distribution on an area basis can be calculated by the following equation (1).

$$\text{Arithmetic average particle diameter}=\Sigma\{q(J)\times X(J)\}\div\Sigma\{q(J)\} \quad (1)$$

In the equation (1), J means a division number of the particle diameter. q(J) means a frequency distribution value (unit: %). X(J) is a representative diameter (unit: μm) in the J-th particle diameter range.

(2) Calculation of Specific Surface Area of Particles Containing Urea-Based Thickener: Requirement (II)

The specific surface area was calculated using the particle size distribution of the particles containing the thickener in the grease composition measured in the section of the above-mentioned Requirement (I). Specifically, the total surface area (unit: $cm^2$) of the particles per unit volume (1 $cm^3$) was calculated using the particle size distribution, and this was taken as the specific surface area (unit: $cm^2/cm^3$).

Next, wear resistance is evaluated by Examples 1 to 4 and Comparative Examples 1 and 2 described above.

[Evaluation of Wear Resistance]

In accordance with the JIS K 7218-A method, a sliding test was performed under the following test conditions, and the amount of wear of the resin material at the sliding portion between the metal material and the resin material was measured. The amount of wear obtained by the following test is a total of a change amount of the resin due to creep deformation of the resin material and a change amount of the resin due to wear of the resin.

Further, the proportion of the amount of wear to the amount of wear of Comparative Example as the reference value (reduction rate of the amount of wear) was calculated, and the wear resistance was evaluated according to the following evaluation criteria. In the following evaluation criteria, a rating of "B" or higher is an operable level.

In Examples 1 to 4 and Comparative Example 2, Comparative Example 1 containing only the base oil (A), the urea-based thickener (B1), and the phenol-based antioxidant was used as a reference value.

(Test Conditions)

Test apparatus: Thrust type sliding test machine (apparatus name: EFM-III-F-ADX-S, manufactured by A&D Company, Limited)

Metal test piece: Roller shape, diameter 1.8 mm, material is S45C

Resin test piece: Ring shape, outer diameter 25.6 mm, inner diameter 20 mm, material is polyamide 66 mixed with 15% by mass of glass fiber Sliding speed: 1.0 m/s Load: 350 N Test time: 45 minutes Test temperature: Room temperature (25° C.)

(Evaluation Criteria for Wear Resistance)

A: The proportion of the amount of wear reduced from the amount of wear of the reference value (reduction rate of the amount of wear) is 75% or more.

B: The proportion of the amount of wear reduced from the amount of wear of the reference value (reduction rate of the amount of wear) is 50% or more and less than 75%.

C: The proportion of the amount of wear reduced from the amount of wear of the reference value (reduction rate of the amount of wear) is less than 50%

The evaluation results are shown in Table 1.

TABLE 1

| Composition component (Unit) | | | | Example 1 | Example 2 | Example 3 | Example 4 | Comparative Example 1 | Comparative Example 2 |
|---|---|---|---|---|---|---|---|---|---|
| Grease composition | Base oil (A) | Base oil (A1) | % by mass | 26.00 | 30.00 | 59.95 | 62.45 | 31.00 | 29.95 |
| | | Base oil (A2) | % by mass | 51.45 | 57.45 | — | — | 60.00 | 60.00 |
| | Urea-based thickener (B) | Urea-based thickener (B1) | % by mass | 8.50 | 8.50 | 8.50 | — | 8.50 | 8.50 |
| | | Urea-based thickener (B2) | % by mass | — | — | — | 8.50 | — | — |
| | Melamine cyanurate (C) | Melamine cyanurate (C2) | % by mass | 0.75 | 0.75 | 1.50 | 0.75 | — | — |
| | Oily agent (D) | Sarcosine derivative (D1) | % by mass | 0.75 | 0.75 | 0.75 | 0.75 | — | 0.75 |
| | | Amine compound (D2) | % by mass | 0.05 | 0.05 | 0.05 | 0.05 | — | 0.05 |
| | | Polyamide compound (D3) | % by mass | 0.25 | 0.25 | 0.25 | 0.25 | — | 0.25 |
| | Anti-wear agent (E) | Ester compound (E1) | % by mass | 1.25 | 1.25 | 2.50 | 1.25 | — | — |
| | | Bisamide compound (E2) | % by mass | 0.50 | 0.50 | 1.00 | 0.50 | — | — |
| | Friction reducing agent (F) | Polymer compound (F1) | % by mass | 10.00 | — | 25.00 | 25.00 | — | — |
| | Additive (G) | Antioxidant | % by mass | 0.50 | 0.50 | 0.50 | 0.50 | 0.50 | 0.50 |
| | Total | | % by mass | 100.0 | 100.0 | 100.0 | 100.0 | 100.0 | 100.0 |
| | Content ratio [(B)/(C)] | | — | 11.33 | 11.33 | 5.67 | 11.33 | — | — |
| | Content ratio [(C)/(D)] | | — | 0.71 | 0.71 | 1.43 | 0.71 | — | — |
| | Content ratio [(C)/(E)] | | — | 0.43 | 0.43 | 0.43 | 0.43 | — | — |
| Physical property values | Base oil (A) (Mixed base oil) | 40° C. Kinematic viscosity | $mm^2/s$ | 145 | 140 | 30 | 30 | 135 | 145 |
| | | Viscosity index | — | 145 | 145 | 130 | 130 | 145 | 145 |
| | Urea-based thickener (B) | Arithmatic average partile diameter of particles | μm | 0.4 | 0.4 | 0.5 | 0.4 | 0.3 | 0.3 |

TABLE 1-continued

| Composition component (Unit) | | | | Example 1 | Example 2 | Example 3 | Example 4 | Comparative Example 1 | Comparative Example 2 |
|---|---|---|---|---|---|---|---|---|---|
| | | Specific surface area of particles | $cm^2/cm^3$ | $1.6 \times 10^5$ | $1.6 \times 10^5$ | $1.2 \times 10^5$ | $1.6 \times 10^5$ | $1.8 \times 10^5$ | $1.8 \times 10^5$ |
| | Grease composition | Worked penetration | — | 300 | 296 | 324 | 305 | 330 | 320 |
| Evaluation results | Wear resistance | Amount of wear of resin (Relative evaluation with reference) | — | A | B | B | A | Reference value | C |

From the results shown in Table 1, it was found that the grease compositions of Examples 1 to 4 had a proportion of the amount of wear reduced from the amount of wear of the reference value (reduction rate of the amount of wear) of 50% or more, and had excellent wear resistance.

On the other hand, in the grease composition of Comparative Example 2 which did not contain melamine cyanurate (C), the proportion of the amount of wear reduced from the amount of wear of the reference value (reduction rate of the amount of wear) was less than 50%, and the amount of wear was not sufficiently reduced.

Next, the wear resistance with respect to the particle size of the melamine cyanurate (C) was verified.

Comparative Example 3

A grease composition of Comparative Example 3 was prepared by removing the phenol-based antioxidant from the composition of Comparative Example 1.

Example 5

To 99 parts by mass of the grease composition of Comparative Example 3, 1 part by mass of melamine cyanurate (C1) was added and mixed. Thereafter, the mixture was homogenized with a three-rollers milling machine to obtain a grease composition of Example 5.

Examples 6 and 7

Grease compositions of Examples 6 and 7 were prepared in the same manner as in Example 5, except that melamine cyanurate (C1) was changed to melamine cyanurate (C2) and (C3), respectively.

[Evaluation of Wear Resistance with Respect to Particle Size of Melamine Cyanurate (C)]

With respect to Examples 5 to 7, using Comparative Example 3 as a reference value, the proportion of the amount of wear to the amount of wear of Comparative Example 3 (reduction rate of the amount of wear) was calculated in the same manner as in the evaluation of wear resistance described above, and the wear resistance was evaluated in accordance with the following evaluation criteria. In the following evaluation criteria, a rating of "B" or higher is an operable level.

(Evaluation Criteria for Wear Resistance)

A: The proportion of the amount of wear reduced from the amount of wear of the reference value (reduction rate of the amount of wear) is 30% or more.

B: The proportion of the amount of wear reduced from the amount of wear of the reference value (reduction rate of the amount of wear) is 20% or more and less than 30%.

C: The proportion of the amount of wear reduced from the amount of wear of the reference value (reduction rate of the amount of wear) is less than 20%

The evaluation results are shown in Table 2.

TABLE 2

| Composition component (Unit) | | | | Example 5 | Example 6 | Example 7 | Comparative Example 3 |
|---|---|---|---|---|---|---|---|
| Grease composition | Base oil (A) | Base oil (A1) | % by mass | 30.50 | 30.50 | 30.50 | 31.50 |
| | | Base oil (A2) | % by mass | 60.00 | 60.00 | 60.00 | 60.00 |
| | Urea-based thickener (B) | Urea-based thickener (B1) | % by mass | 8.50 | 8.50 | 8.50 | 8.50 |
| | Melamine cyanurate (C) | Melamine cyanurate (C1) | % by mass | 1.00 | — | — | — |
| | | Melamine cyanurate (C2) | % by mass | — | 1.00 | — | — |
| | | Melamine cyanurate (C3) | % by mass | — | — | 1.00 | — |
| Total | | | % by mass | 100.0 | 100.0 | 100.0 | 100.0 |
| Content ratio [(B)/(C)] | | | — | 8.50 | 8.50 | 8.50 | — |
| Physical property values | Base oil (A) (Mixed base oil) | 40° C. Kinematic viscosity | $mm^2/s$ | 140 | 140 | 140 | 135 |
| | | Viscosity index | — | 145 | 145 | 145 | 145 |
| | Urea-based thickener (B) | Arithmatic average partile diameter of particles | μm | 0.3 | 0.3 | 0.3 | 0.3 |
| | | Specific surface area of particles | $cm^2/cm^3$ | $1.8 \times 10^5$ | $1.8 \times 10^5$ | $1.8 \times 10^5$ | $1.8 \times 10^5$ |

TABLE 2-continued

| Composition component (Unit) | | | | Example 5 | Example 6 | Example 7 | Comparative Example 3 |
|---|---|---|---|---|---|---|---|
| | Grease composition | Worked penetration | — | 330 | 330 | 330 | 330 |
| Evaluation results | Wear resistance | Amount of wear of resin (Relative evaluation with reference) | — | B | B | A | Reference value |

As shown in Table 2, in the grease compositions of Examples 5 and 6, the proportion of the amount of wear reduced from the amount of wear of the reference value (reduction rate of the amount of wear) was 20% or more and less than 30%. Further, in the grease composition of Example 7, the proportion of the amount of wear reduced from the amount of wear of the reference value (reduction rate of the amount of wear) was 30% or more. From these results, it was found that the smaller the average particle diameter of the melamine cyanurate (C) in the grease composition, the more excellent the wear resistance.

REFERENCE SIGNS LIST

1: Grease manufacturing apparatus
2: Container body
3: Rotor
4: Introduction portion
4A, 4B: Solution introducing pipe
5: Retention portion
6: First concave-convex portion
7: Second concave convex portion
8: Discharge portion
9: First concave convex portion on the side of container body
10: Second concave convex portion on the side of container body
11: Discharge port
12: Rotation axis
13: First concave convex portion of rotor
13A: Concave portion
13B: Convex portion
14: Second concave convex portion of rotor
15: Scraper
A1, A2: Gap

The invention claimed is:

1. A grease composition, comprising:
a base oil;
a urea-based thickener;
melamine cyanurate; and
an oily agent;
wherein a particle diameter of the melamine cyanurate is 5.0 μm or less, a content ratio of the urea-based thickener to the melamine cyanurate is in a range of 1.0 to 18.0 in terms of a mass ratio, the oily agent comprises one or more selected from the group consisting of a sarcosine derivative, an amine compound, a polyamide compound, and an ether compound, a content ratio of the melamine cyanurate to the oily agent is in a range of 0.3 to 3.0 in terms of a mass ratio, and particles comprising the urea-based thickener in the grease composition satisfy that the particles have an area-based arithmetic average particle diameter of 2.0 μm or less, as measured by a laser diffraction/scattering method.

2. The grease composition according to claim 1, wherein the particles comprising the urea-based thickener further satisfy that the particles have a specific surface area of $0.5\times10^5$ $cm^2/cm^3$ or more, as measured by a laser diffraction/scattering method.

3. The grease composition according to claim 1, wherein a content of the melamine cyanurate is 0.2% by mass or more based on the total amount of the grease composition.

4. The grease composition according to claim 1, further comprising:
one or more anti-wear agents selected from the group consisting of an ester compound and a bisamide compound.

5. The grease composition according to claim 4, wherein a content ratio of the melamine cyanurate to the anti-wear agent is in a range of 0.1 to 2.0 in terms of a mass ratio.

6. The grease composition according to claim 1, wherein a content of the urea-based thickener is in a range of 1.0% by mass to 20.0% by mass based on the total amount of the grease composition.

7. The grease composition according to claim 1, wherein the base oil has a 40° C. kinematic viscosity of in a range of 30 $mm^2/s$ to 200 $mm^2/s$.

8. The grease composition according to claim 1, wherein the grease composition has a worked penetration of in a range of 260 to 330.

9. A lubricating composition for a sliding mechanism of a metal material and a resin material, comprising:
the grease composition of claim 1.

10. The lubricating composition according to claim 9, wherein the resin material is a glass fiber reinforced resin material.

11. A lubricating method, comprising:
lubricating a sliding mechanism of a metal material and a resin material with the grease composition of claim 1.

12. The lubricating method according to claim 11, wherein the resin material is a glass fiber reinforced resin material.

13. The grease composition according to claim 2, wherein a content of the melamine cyanurate is 0.2% by mass or more based on the total amount of the grease composition.

14. The grease composition according to claim 2, further comprising:
one or more anti-wear agents selected from the group consisting of an ester compound and a bisamide compound.

15. The grease composition according to claim 14, wherein a content ratio of the melamine cyanurate to the anti-wear agent is in a range of 0.1 to 2.0 in terms of a mass ratio.

16. The grease composition according to claim 2, wherein a content of the urea-based thickener is in a range of 1.0% by mass to 20.0% by mass based on the total amount of the grease composition.

17. The grease composition according to claim 2, wherein the base oil has a 40° C. kinematic viscosity of in a range of 30 $mm^2/s$ to 200 $mm^2/s$.

18. The grease composition according to claim 2, wherein the grease composition has a worked penetration of in a range of 260 to 330.

19. The grease composition according to claim 3, further comprising:

one or more anti-wear agents selected from the group consisting of an ester compound and a bisamide compound.

20. The grease composition according to claim 19, wherein a content ratio of the melamine cyanurate to the anti-wear agent is in a range of 0.1 to 2.0 in terms of a mass ratio.

* * * * *